US005570886A

United States Patent [19]

Rigal et al.

[11] Patent Number: 5,570,886

[45] **Date of Patent: *Nov. 5, 1996**

[54] GOLF CLUB HEAD HAVING AN INNER SUBASSEMBLY AND AN OUTER CASING AND METHOD OF MANUFACTURE

[75] Inventors: Jean-Pierre Rigal, La Balme-de-Sillingy; Benoît Vincent, Annecy-le-Vieux, both of France

[73] Assignee: Taylor Made Golf Company, Inc., Carlsbad, Calif.

[ * ] Notice: The term of this patent shall not extend beyond the expiration date of Pat. No. 5,547,427.

[21] Appl. No.: 307,799

[22] PCT Filed: Feb. 26, 1993

[86] PCT No.: PCT/FR93/00195

§ 371 Date: Sep. 30, 1994

§ 102(e) Date: Sep. 30, 1994

[87] PCT Pub. No.: WO93/19816

PCT Pub. Date: Oct. 14, 1993

[30] Foreign Application Priority Data

Apr. 1, 1992 [FR] France ..... 92 04189

[51] Int. Cl.[6] ..... A63B 53/04

[52] U.S. Cl. ..... 473/345; 473/335; 473/349

[58] Field of Search ..... 273/167 R, 167 A, 273/167 H, 167 F, 170, 171, 172, 173, 174, 169, 78, 79, 193 R, 194 R, 186.2, 187.4; 29/527.1, 428, 469.5

[56] References Cited

U.S. PATENT DOCUMENTS

| | | | |
|---|---|---|---|
| 3,211,455 | 10/1965 | Hyden | 273/173 |
| 4,438,931 | 3/1984 | Motomiya | 273/167 H |
| 4,545,580 | 10/1985 | Tomita | 273/167 R |
| 4,602,787 | 7/1986 | Sugioka et al. | 273/171 |
| 4,809,978 | 3/1989 | Yamaguchi et al. | 273/78 |
| 4,811,949 | 3/1989 | Kobayashi | 273/167 H |
| 4,984,800 | 1/1991 | Hamada | 273/167 F |
| 5,000,454 | 3/1991 | Soda | 273/167 A |
| 5,024,437 | 6/1991 | Anderson | 273/78 |
| 5,106,094 | 4/1992 | Desbiolles et al. | 273/167 H |

FOREIGN PATENT DOCUMENTS

| | | | |
|---|---|---|---|
| 101426 | 2/1984 | European Pat. Off. | 273/167 H |
| 0400277 | 5/1990 | European Pat. Off. . | |
| 2550457 | 2/1985 | France . | |
| 2635688 | 3/1990 | France . | |
| 2657530 | 8/1991 | France . | |
| 61-33973 | 10/1986 | Japan . | |

*Primary Examiner*—Sebastiano Passaniti
*Attorney, Agent, or Firm*—Greenblum & Bernstein P.L.C.

[57] ABSTRACT

The invention is related to a golf club head including an internal subassembly defining an inner space and including a combination of a rigid, hollow and open internal shell made of a low-density material, and an impact-resistant sealing element co-operating with the shell to close off the inner space and having an inner wall for supporting the striking surface of the head. The internal shell is covered by an outer plastic casing at least partially covering the internal subassembly and forming the outer wall of the striking surface.

23 Claims, 4 Drawing Sheets

Fig: 10
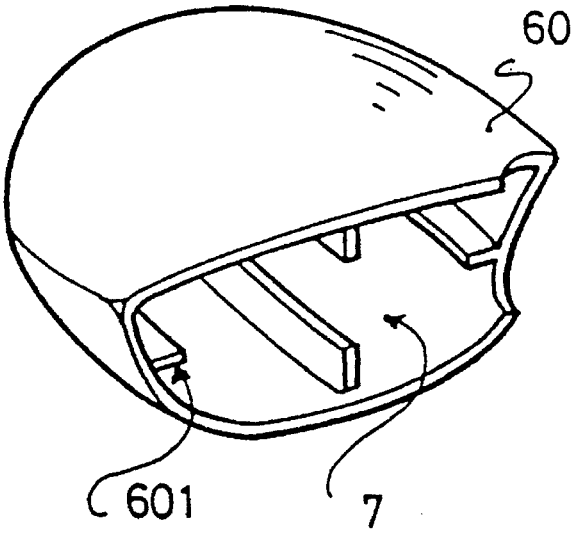
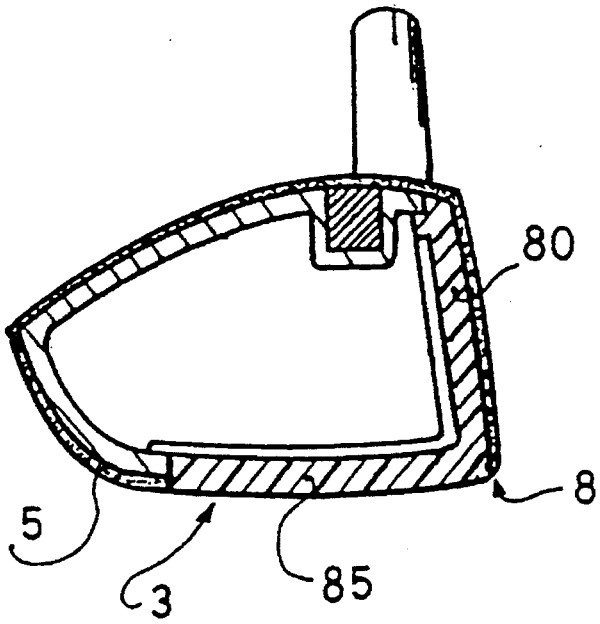
Fig: 11
Fig: 12
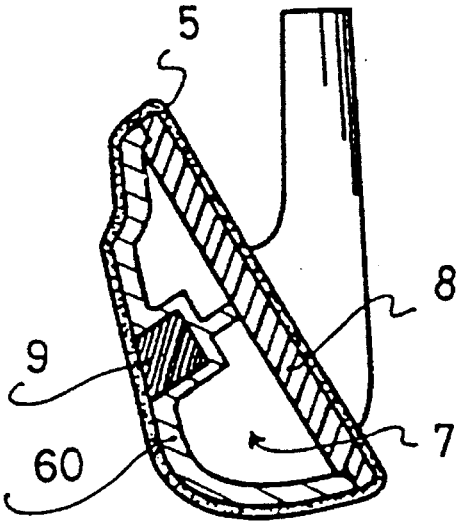

GOLF CLUB HEAD HAVING AN INNER SUBASSEMBLY AND AN OUTER CASING AND METHOD OF MANUFACTURE

BACKGROUND OF THE INVENTION

1. Field of the Invention

The present invention is related to a new construction for a golf club head, especially a head of the "wood" type, as well as to the method of manufacturing such a head.

2. Discussion of Background and Material Information

The golf club used typically at the start of a hole is commonly known as the "driver". It generally has a hollow metallic head with a slight thickness and is constituted by the assembly of several metal elements welded to one another to define a closed inner cavity. Such constructions, described in U.S. Pat. No. 4,438,931, U.S. Pat. No. 5,024,437 and Japanese Patent Publication No. 61-33973, for example, result in clubs whose tolerance cannot be improved beyond a certain threshold due to the critical mass of the head and due to the isotropic character of the material. Indeed, generally it is not possible to add weights to the club head without increasing the mass limit beyond a point at which it is no longer possible to obtain the correct balance for the club and, furthermore, the distribution of mass is very closely linked to the shape of the head itself.

Another disadvantage of this type of head is related to the nature of the material that constitutes the impact surface, i.e., the ball-striking face, which, although enabling a direct transmission of information to the player, provides a disagreeable sensation and sound at impact.

Heads constructed entirely of a composite material, with the exception of the sole, have appeared over the last few years. These types of constructions are very rarely favored by professional golfers because, most often, they are constructed in a single piece by the compression molding method, without any particular regard to the distribution of mass.

SUMMARY OF THE INVENTION

It is the object of the present invention to provide a golf club head having a new construction that overcomes the aforementioned disadvantages, i.e., on the one hand, enabling improvement of the sensation perceived by the player at impact, while retaining direct transmission of information to the player, and, on the other hand, increasing the mass distribution and concentration possibilities so that the head becomes more tolerant by increasing its moments of inertia.

Another object of the invention is to improve the transmission of the energy of the mass, so divided and concentrated, directly towards the impact surface. The invention also has the advantage of being able to be implemented by various techniques and in a wide choice of materials.

To this end, the present invention is related to a golf club head that includes, on the one hand, an inner subassembly defining an inner space and, on the other hand, an outer covering and protective casing made of a plastic material at least partially covering the subassembly. The inner subassembly is constituted by the assembly of a rigid inner shell, hollow and open, made of a low-density material and an impact-resistant sealing element cooperating with the shell so as to close off the inner space, such element comprising an inner wall constituting the support for the striking surface of the head.

Furthermore, the inner shell comprises at least one housing provided in the area of its peripheral wall, within which is positioned an additional mass made of a high-density material and covered by the outer casing.

The shell includes, on the other hand, inner reinforcement walls or ribs so as to provide the shell with maximum rigidity in order that it may avoid deformation, and so as to improve the direct transmission of the energy from the additional mass towards the impact surface.

BRIEF DESCRIPTION OF THE DRAWINGS

The invention will be more fully described and other characteristics and advantages of the invention will become apparent from the description that follows with reference to the annexed drawings that are provided only as non-limiting examples thereof.

FIG. 10 is a perspective view of another embodiment of the shell of the club head according to the invention;

FIG. 11 is a side elevational sectional view along line 2—2 of another variation of FIG. 2; and FIG. 12 is a side elevational sectional view of an "iron" type head according to the invention.

DETAILED DESCRIPTION OF THE PREFERRED EMBODIMENTS

Figure 1:
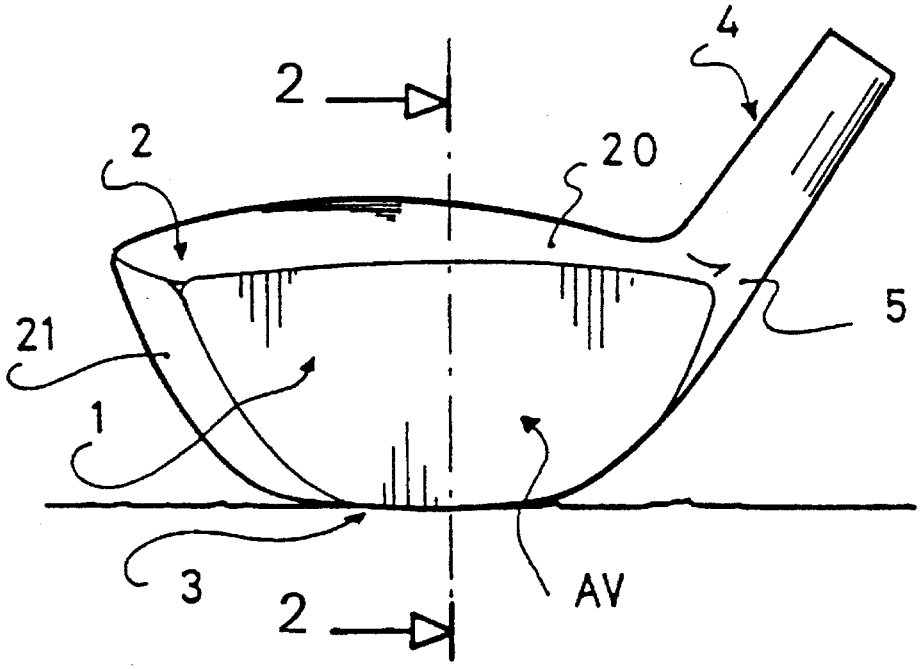
FIG. 1 is a front elevational view of a "wood" type head, and especially a head of the invention.

In FIG. 1, a golf club head according to the invention, especially of the "wood" type, is represented in a front elevational view. The club head has a front portion AV constituting the impact surface 1, a main portion constituting the body 2, a lower portion constituting the sole 3 and, finally, an upper portion extending from the body upwardly, constituting the neck or cavity 4. The body can be arbitrarily sub-divided into two sub-portions, viz., an upper sub-portion or top 20 of the body and a lower sub-portion constituting or bottom 21 of the body. The assembly of portions 1, 2, 3, 4 constituting the head is covered by an outer casing 5 having a slight thickness obtained from a molded plastic material. The outer casing 5 is made from an injected thermoplastic material such as aramide, or even an thermohardenable resin reinforced with carbon fiber sheeting, for example, or even resin manufactured by the RIM (Injection Molding Reaction) method. The material may be fiber-reinforced or one could choose that it not be fiber-reinforced. The outer casing has a thickness that is relatively thin, on the order of 1 to 4 mm.

Figure 2:
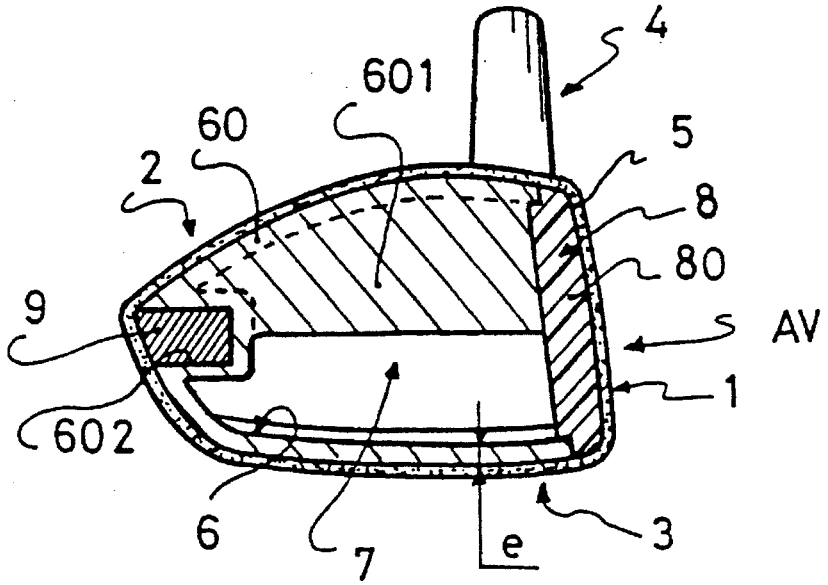
FIG. 2 is a side elevational sectional view along line 2—2 of FIG. 1.

As is shown in FIG. 2, casing 5 entirely covers an inner subassembly 6 constituted by several elements. This inner subassembly 6 comprises an inner shell 60, which is hollow and open towards the front AV of the head. It is made of a low-density, though rigid material. Its mass can vary from approximately 14 to 39 g. It is made from a plastic material, preferably from a molded thermoplastic material, such as polyamide, ABS, polyamide based copolymer, for example.

The modulus of the material as well as the thickness of shell 60 must be adequate so as to enable it to resist the compression exerted by the impact of the ball under normal usage conditions. To increase its rigidity, the shell can include inner reinforcement walls or ribs 601, as is shown in more detail in FIG. 3.

Shell 60 and the inner reinforcement walls 601 are preferably made of a single injection-molded element.

The average thickness e of the peripheral wall of the shell 60 as well as the average thickness of its reinforcement walls can be between approximately 1.5 and 3 mm. It can also be provided that the shell be reinforced by the adjunction of short glass or carbon fibers, for example.

Inner space 7 is defined by the assembly of shell 60 and of a sealing element 8 that alone constitutes the impact or striking surface 1 of the head. Such space could possibly be partially or entirely occupied by a low-density foam, such as polyurethane, for example. As for the outer wall of striking surface 1, it is constituted by the outer casing 5 portion of the striking surface.

Sealing element 8 has a mass comprised between approximately 45 and 65 g and is made of metal, preferably of steel, aluminum or an aluminum alloy. The function of sealing element 8 is to resist shocks during the impact of the ball and it must therefore have an adequate thickness. In the case of steel, the average thickness of inner wall 80 is comprised between approximately 2.5 and 3 mm. In the case of titanium, the thickness is comprised between approximately 3 and 4 mm. Finally, in the case of aluminum, it is comprised between approximately 4 and 5 mm.

This element can be manufactured by break-mold wax or by forging, especially if steel is used. It can be manufactured by injection or by gravity molding in the case of aluminum.

Figure 3:
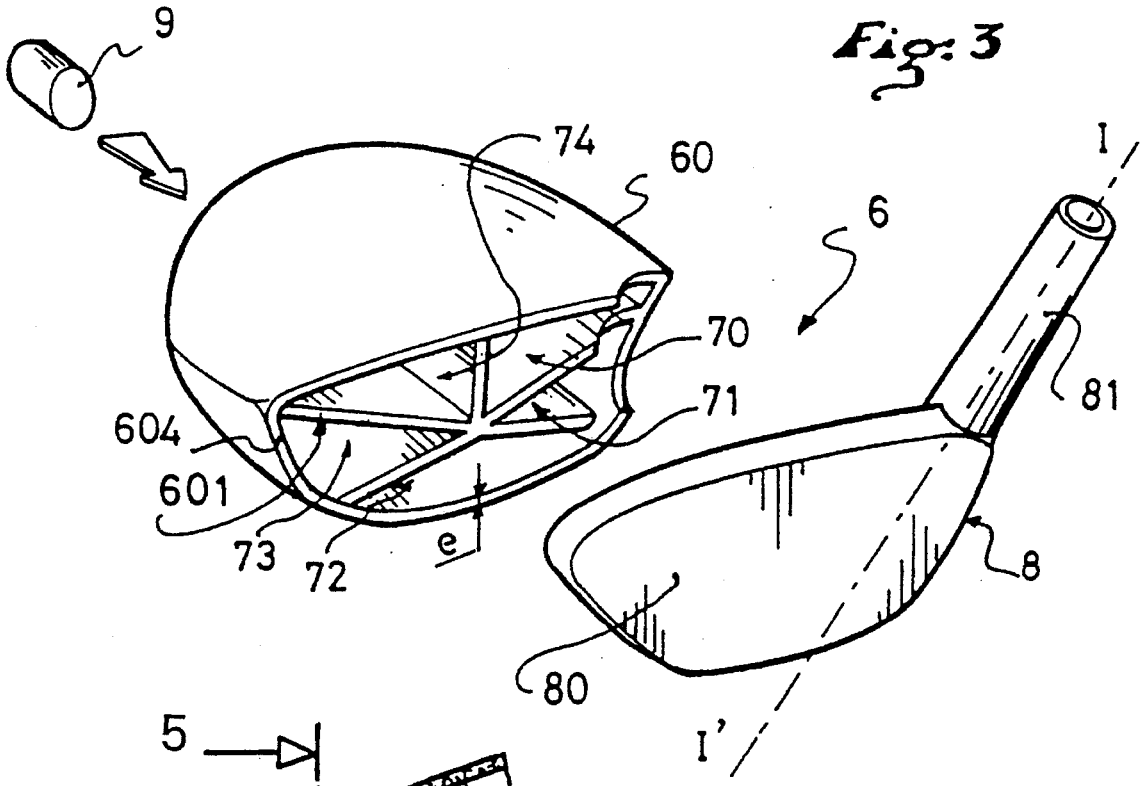
FIG. 3 is a perspective view showing the inner subassembly of the head before assembly of its various component elements.

As is shown in FIG. 3, the sealing element 8 extends upwardly and along the side of the impact surface by an upper portion 81 having a tubular section, constituting the neck, which is adapted to receive the club shaft. Upper portion 81 is generally offset towards the rear with respect to the impact surface, which means that axis I–I' of the neck is itself offset towards the rear of the impact surface and its extension does not intersect such impact surface. The upper tubular portion 81 of sealing element 8 can be manufactured separately from the inner wall 80 and then molded thereto. In this case, it can be arranged that the inner wall 80 is obtained by forging, punching or molding. But it can also be provided that the sealing element can be molded in one piece by break-mold wax, for example.

This special construction described hereinabove of the sealing element has the advantage of directly transmitting information to the hands of the player at impact with the ball.

As is shown in FIG. 2, the inner shell 60 comprises one (or several) housing(s) 602 located at its periphery. Each housing 602 is occupied by an additional mass 9 made of a high-density material and is connected to the inner wall of sealing element 80 by means of inner reinforcement walls 601. Thus, any deformation of the shell is avoided and the energy of mass 9 is transmitted directly to the impact surface, thus producing a "hammer effect" without dissipation in the peripheral wall of the shell.

The additional mass 9 is made in one piece, for example, and is made of a heavy metal, such as lead, nickel, copper or others. The density of the material used is preferably greater than 7. The mass 9 can be force-fitted in the housing, screwed in place or even glued. The outer casing 5 covers the surface of mass 9 that would otherwise remain exposed and provides the closure as well as the seal for the housing 602.

One can provide, as an example, a mass distribution that can be obtained for a "wood" type head and for balancing a club with a total length of 43.5 inches (1104.9 mm) at a static moment (measured at 14 inches, or 355.6 mm, from the upper end of the club).

The shaft is of the commercial DYNAMIC GOLD S300 type whose mass is equal to 116 g. The grip has a mass of 50 g.

Balancing requirements impose a head mass limit of 187 g.

The distribution of mass for each element constituting the head, as described above, without the consideration of additional mass for balancing, e.g., is as follows:

mass of sealing element (8)=54±10 g, mass of inner shell (60)=25±10 g, mass of outer casing (5)=40±10 g, foam=10 g approximately, total mass of head=129±30 g.

The available mass increase in order to obtain proper balancing of the head by means of additional weights for the head is therefore approximately 58 g with boundary values of 28 g and 88 g, which primarily depend on the rigidity and density of the materials used for the various elements of the head.

Figure 4:
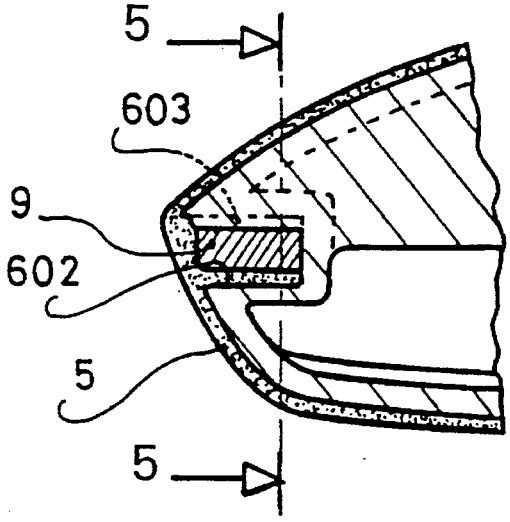
FIG. 4 is a partial sectional view along line 2—2 of the rear portion of the head of the view of FIG. 1, showing a detail of a particular embodiment of the invention.
Figure 5:
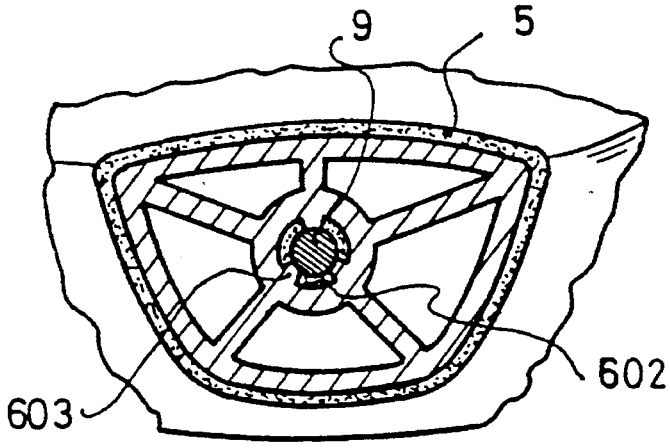
FIG. 5 is a side elevational sectional view along line 5—5 of FIG. 4 showing the same embodiment detail.

FIGS. 4 and 5 illustrate a preferred method of integrating the additional mass between shell 80 and outer casing 5, thus ensuring a better affixation. To this end, housing 602 of shell 60 comprises several ribs 603 located on the circumference of the periphery of the housing. Between each rib, a recess is created, filled by the plastic material of the outer casing 5 obtained by the flux of the plastic material during the molding operation of the casing.

Figure 6:
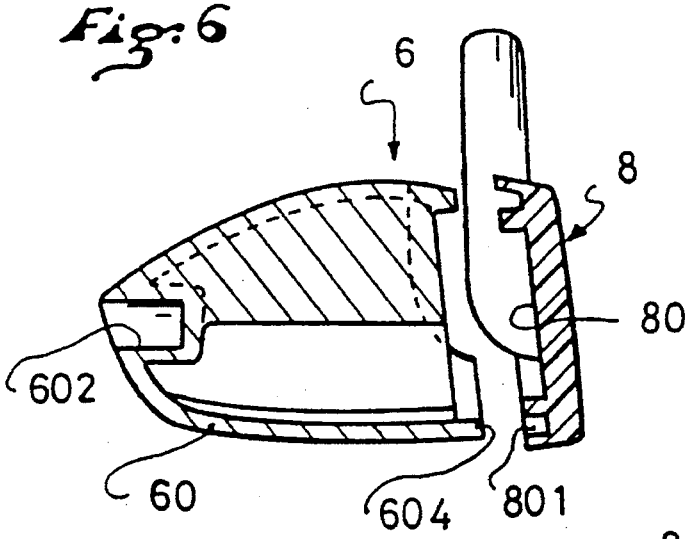
FIG. 6 is a side elevational sectional view along line 2—2 of FIG. 1 of the inner subassembly before assembly and according to a variation of the invention.

FIG. 6 illustrates a special embodiment of sealing element 8, enabling its centering and positioning with respect to the inner shell 60 to be improved. The inner surface of wall 80 of element 8 is provided with a peripheral groove 801, which cooperates with the peripheral edge 604 of the shell 60 to obtain the centering of the sealing element 8 on the shell and the closure of inner subassembly 6.

In this example, no special affixation method is required between the shell 60 and the sealing element 8 because the affixation of such elements to each other can be obtained by the outer casing 5 alone.

Figure 7:
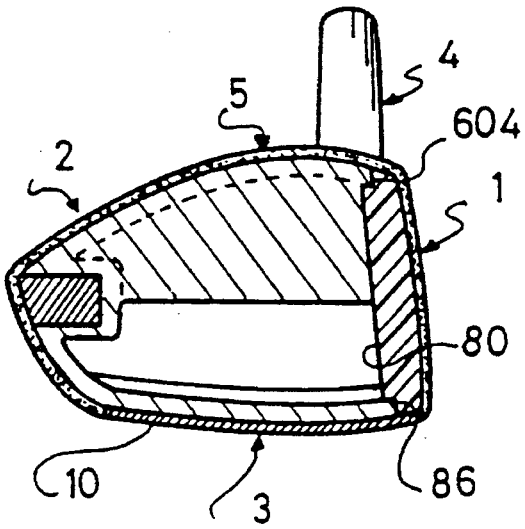
FIG. 7 is a side elevational sectional view along line 2—2 of a variation of FIG. 2.

FIG. 7 illustrates a variation according to the invention wherein outer casing 5 made of a plastic material only partially covers the head, i.e., the impact surface 1, body 2 and cavity 4 of the head are covered. The sole 3 of the club head is constituted by an independent element 10 made of an abrasion resistant material, such as aluminum or an aluminum alloy, for example. This element can be screwed, riveted or glued to the shell, for example.

As can also be seen from FIG. 7, the centering of wall 80 with respect to shell 60 can be done by providing a peripheral shoulder 86 provided on the inner surface of wall 80 that cooperates with peripheral edge 604 of the shell.

Figure 8:
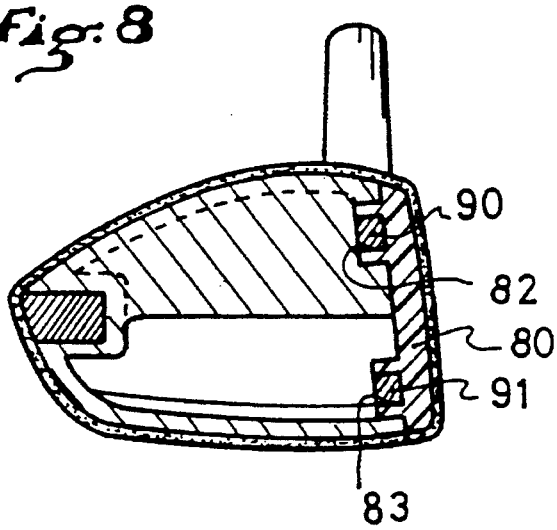
FIG. 8 is a side elevational sectional view along line 2—2 of the club head of the invention according to another variation.

FIG. 8 illustrates a variation of the invention whereby the additional masses 90, 91 are affixed to the inner wall 80 of the sealing element 8 and are arranged in housings 82, 83 of element 8 provided to this end.

Such a construction has the advantage of enabling the refinement of the position of the center of gravity and the position of the axes of inertia of the head.

Figure 9:
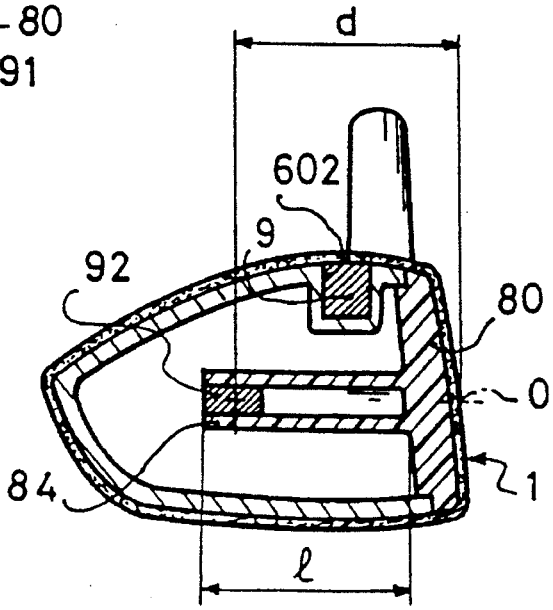
FIG. 9 is a side elevational sectional view along line 2—2 according to another variation.

FIG. 9 illustrates another variation having the same objective as the previous one, by affixing an additional mass 92 to an inner portion 84 of the sealing element 8, extending it along a certain length l in the inner space.

For example, portion 84 can be a hollow tube in which the additional mass 92 is fixed, by any means such as welding, soldering, screwing, etc. The longitudinal position of the mass 92 with respect to center O of surface 1, translated by the measurement of a certain distance d, can be easily adjusted by displacing the mass 92 inside tube 84 and will directly influence the position of hte center of gravity of the head.

In the case of FIG. 9, as in the case of each of the previously specified examples, one (or several) housing(s) 602 containing an (several) additional mass(es) 9 can be provided at any desired point on the peripheral wall of inner shell 60 as, for example, in the vicinity of the periphery of the inner wall 80 of the sealing element 8.

In the example of FIGS. 2 through 5, the shell 60 is provided with inner reinforcement walls 601 that separate the inner space 7 into various cavities 70, 71, 72, 73, 74. It can be provided that each inner wall 601 has one (or several) orifice(s), (not represented), enabling the contiguous cavities to come into contact with one another. Thus during foaming of a filler material into inner space 7, the distribution of the foam occurs normally.

It can be provided, as is shown in FIG. 10, that the reinforcement walls be replaced by simple ribs 601 so as to facilitate the filling of the inner space 7.

FIG. 11 illustrates a variation of the invention whereby the sealing element 8 extends downwardly by a lower wall 85 to constitute the actual sole 3 of the head. Such a construction has the advantage of improving the abrasion resistance of the sole. In this case, the outer casing 5 may cover the entire head assembly, with the exception of sole 3.

The invention can also apply to all types of club heads, especially club heads of the "iron" type as is shown in FIG. 12. The inner space 7 defined by the assembly of shell 60 and sealing element 8 is smaller than in the case of a "wood" type head, but the principle of construction remains identical for each of the variations described previously.

The invention is also related to the method enabling such club head to be constructed and it includes the performance of the following manufacturing steps:

Firstly, on the one hand, the rigid, hollow and open inner shell 60 is made separately by injection of a plastic material in a mold, while ensuring the formation of one (or several) housing(s) in its peripheral wall, and on the other hand, sealing element 8 is made from metal by molding or forging.

Thereafter, a closed subassembly is produced by forming the assembly of sealing element 8 and shell 60 so as to close off inner space 7, the sealing element constituting the front of the head;

an additional mass of material 9, made of high-density metal, is arranged in each housing 602 located at the periphery of inner shell 60;

subsequently, a thin plastic outer casing 6 is applied by molding onto the closed subassembly, completely or partially covering the subassembly, so as to obtain the affixation of each element of the subassembly to one another. The molding operation can consist of pressure injecting a plastic material, for example. In this case, the injection pressures applied are of the order of approximately 250 to 450 bars. In this particular case, a previous step can be provided, consisting of filling the subassembly with a non-compressible material, thus ensuring the mechanical resistance of the shell during the forthcoming injection operation. Subsequently, the material can be eliminated, after this operation. As an example, one can cite the use of adapted materials such as low melting point wax that can be melted at temperatures of about 50° to 70° C. inside the subassembly, and that can be evacuated easily. One can also envision the use of water-soluble urea, or even sand with a meltable bonding additive such as wax.

An intermediate step can consist of injecting the components of a filler foam into inner space 7, such foam reacting "in situ" and having very low density, after the formation of closed subassembly 6 and before the covering step of outer casing 5.

This could be a polyurethane foam, for example, adapted to provide a more pleasant sound at the impact of the head with the ball, which is generally more appreciated by golfers.

The foam injection operation can also be done to balance the club once it is finished. This would then be the final step that is implemented after the subassembly 6 has been covered by outer casing 5, and generally after the assembly of the head on the club shaft. To this end, a filling orifice is provided in the head. The filling method is described notably in French Patent Publication No. 2,657,530, for example.

The invention is not limited to the embodiments described and represented as examples, and also comprises all technical equivalents and combinations thereof.

We claim:

1. A golf club head comprising:

an inner subassembly defining an inner space, said inner subassembly comprising:

a rigid inner shell made of a low density material, said inner shell having an inner space and a forwardly facing opening; and an impact-resistant sealing element cooperating with said inner shell for closing said opening of said inner shell, said sealing element comprising an inner wall for supporting a ball-striking surface of the club head; and an outer casing made of a plastic material, said outer casing at least partially covering said inner sub-assembly, said outer casing comprising the ball-striking surface, wherein between said ball-striking surface and said impact-resistant sealing element, said outer casing comprises only a single layer of plastic material.

2. A golf club head according to claim 1, wherein:

said inner shell is made from an injection-molded thermoplastic material.

3. A golf club head according to claim 1, wherein:

said outer casing has a thickness comprised between 1 mm and 4 mm.

4. A golf club head according to claim 3, wherein:

said outer casing is made of a thermohardenable resin reinforced with carbon fiber sheeting.

5. A golf club head according to claim 3, wherein:

said outer casing is made of a molded fiber-reinforced thermoplastic material.

6. A golf club head according to claim 1, further comprising:

a very low density filler foam within said inner space of said inner shell.

7. A golf club head comprising:

an inner subassembly defining an inner space, said inner subassembly comprising:

a rigid inner shell made of a low density material, said inner shell having an inner space and a forwardly facing opening; and an impact-resistant sealing element cooperating with said inner shell for closing said opening of said inner shell, said sealing element comprising an inner wall for supporting a ball-striking surface of the club head; and an outer casing made of a plastic material, said outer casing at least partially covering said inner sub-assembly, said outer casing comprising the ball-striking surface;

wherein said inner shell comprises, at a periphery of said inner shell, at least one housing, said housing having therewithin an additional mass made of a high-density material and said housing is covered by said outer casing.

8. A golf club head comprising:

an inner subassembly defining an inner space, said inner subassembly comprising:

a rigid inner shell made of a low density material, said inner shell having an inner space and a forwardly facing opening; and an impact-resistant sealing element cooperating with said inner shell for closing said opening of said inner shell, said sealing element comprising an inner wall for supporting a ball-striking surface of the club head; and an outer casing made of a plastic material, said outer casing at least partially covering said inner sub-assembly, said outer casing comprising the ball-striking surface;

wherein said inner shell comprises at least one inner reinforcement rib.

9. A golf club head comprising:

an inner subassembly defining an inner space, said inner subassembly comprising:

a rigid inner shell made of a low density material, said inner shell having an inner space and a forwardly facing opening; and an impact-resistant sealing element cooperating with said inner shell for closing said opening of said inner shell, said sealing element comprising an inner wall for supporting a ball-striking surface of the club head; and an outer casing made of a plastic material, said outer casing at least partially covering said inner sub-assembly, said outer casing comprising the ball-striking surface;

wherein said inner shell comprises a plurality of inner reinforcement ribs.

10. A golf club head comprising:

an inner subassembly defining an inner space, said inner subassembly comprising:

a rigid inner shell made of a low density material, said inner shell having an inner space and a forwardly facing opening; and an impact-resistant sealing element cooperating with said inner shell for closing said opening of said inner shell, said sealing element comprising an inner wall for supporting a ball-striking surface of the club head; and an outer casing made of a plastic material, said outer casing at least partially covering said inner sub-assembly, said outer casing comprising the ball-striking surface;

wherein said inner shell is made from an injection-molded thermoplastic material; and said inner shell has a thickness comprised between 1.5 mm and 3 mm.

11. A golf club head comprising:

an inner subassembly defining an inner space, said inner subassembly comprising:

a rigid inner shell made of a low density material, said inner shell having an inner space and a forwardly facing opening; and an impact-resistant sealing element cooperating with said inner shell for closing said opening of said inner shell, said sealing element comprising an inner wall for supporting a ball-striking surface of the club head;

an outer casing made of a plastic material, said outer casing at least partially covering said inner sub-assembly, said outer casing comprising the ball-striking surface;

a plurality of masses; and a plurality of housings affixed to a rearwardly facing wall of said sealing element for housing respective ones of said plurality of masses.

12. A golf club head according to claim 11, wherein:

said rearwardly facing wall of said sealing element comprises at least a tubular portion extending rearwardly within said inner space of said inner shell; and an additional mass is positioned within said tubular portion of said rearwardly facing wall, said additional mass having a center of gravity located a predeterminate distance from a center of the ball-striking surface.

13. A golf club head comprising:

an inner subassembly defining an inner space, said inner subassembly comprising:

a rigid inner shell made of a low density material, said inner shell having an inner space and a forwardly facing opening; and an impact-resistant sealing element cooperating with said inner shell for closing said opening of said inner shell, said sealing element comprising an inner wall for supporting a ball-striking surface of the club head; and an outer casing made of a plastic material, said outer casing at least partially covering said inner sub-assembly, said outer casing comprising the ball-striking surface;

wherein said inner wall of said sealing element extends upwardly to form an upper portion having a tubular section forming a neck for receiving a force-fitted club shaft.

14. A golf club head comprising:

an inner subassembly defining an inner space, said inner subassembly comprising:

a rigid inner shell made of a low density material, said inner shell having an inner space and a forwardly facing opening; and an impact-resistant sealing element cooperating with said inner shell for closing said opening of said inner shell, said sealing element comprising an inner wall for supporting a ball-striking surface of the club head; and an outer casing made of a plastic material, said outer casing at least partially covering said inner sub-assembly, said outer casing comprising the ball-striking surface;

wherein said sealing element is made of metal by molding.

15. A golf club head according to claim 13, wherein:

said sealing element is made of aluminum or an aluminum alloy.

16. A golf club head comprising:

an inner subassembly defining an inner space, said inner subassembly comprising:

a rigid inner shell made of a low density material, said inner shell having an inner space and a forwardly facing opening; and an impact-resistant sealing element cooperating with said inner shell for closing said opening of said inner shell, said sealing element comprising an inner wall for supporting a ball-striking surface of the club head; and an outer casing made of a plastic material, said outer casing at least partially covering said inner sub-assembly, said outer casing comprising the ball-striking surface, said outer casing having a thickness comprised between 1 mm and 4 mm, said outer casing being made of a molded non-fiber-reinforced thermoplastic material.

17. A method of manufacturing a golf club head, the golf club head having (A) an inner subassembly defining an inner space, said inner subassembly including a plurality of elements, said plurality of elements comprising (a) a rigid inner shell made of a low density material, said inner shell having an inner space and a forwardly facing opening, and (b) an impact-resistant metallic sealing element cooperating with said inner shell for closing said opening of said inner shell, said sealing element comprising an inner wall for supporting a ball-striking surface of the club head; and (B) an outer casing made of a plastic material, said outer casing at least partially covering said inner sub-assembly, said outer casing comprising the ball-striking surface, said method of manufacturing a golf club head comprising:

forming said inner shell by injecting plastic material in a mold, said forming including forming at least one housing at a peripheral portion of said inner shell;

forming said metallic sealing element;

positioning said sealing element at said opening of said inner shell to close said inner shell to thereby form a closed inner subassembly;

positioning a mass of high-density material within each of predeterminate ones of said at least one housing of said inner shell; and applying the outer casing to said inner subassembly to at least partially cover said inner subassembly to thereby secure said plurality of elements of said inner subassembly with respect to one another.

18. A method of manufacturing a golf club head according to claim 17, wherein:

said forming said inner shell comprises forming a plurality of housings at the peripheral portion of said inner shell.

19. A method of manufacturing a golf club head according to claim 17, wherein:

said forming said metallic sealing element comprises forming said metallic sealing element by molding.

20. A method of manufacturing a golf club head according to claim 17, wherein:

said forming said metallic sealing element comprises forming said metallic sealing element by forging.

21. A method of manufacturing a golf club head according to claim 17, wherein:

said applying the outer casing to said inner subassembly to at least partially cover said inner subassembly comprises applying the outer casing to said inner subassembly to completely cover said inner subassembly.

22. A method of manufacturing a golf club head according to claim 17, further comprising, after said positioning said sealing element at said opening of said inner shell to close said inner shell and before applying the outer casing to said inner subassembly to at least partially cover said inner subassembly:

injecting into said inner space components of a very low density filler foam for reacting "in situ".

23. A golf club head according to claim 1, wherein:

said outer casing comprises a single layer of plastic material between said ball-striking surface and said impact-resistant sealing element.

* * * * *